US008235545B2

(12) United States Patent
Zheng et al.

(10) Patent No.: US 8,235,545 B2
(45) Date of Patent: Aug. 7, 2012

(54) LED TUBE

(75) Inventors: Shi-Song Zheng, Shenzhen (CN); Zhong-Liang Lu, Shenzhen (CN)

(73) Assignees: Fu Zhun Precision Industry (Shen Zhen) Co., Ltd., Shenzhen, Guangdong Province (CN); Foxconn Technology Co., Ltd., Tu-Cheng, New Taipei (TW)

( * ) Notice: Subject to any disclaimer, the term of this patent is extended or adjusted under 35 U.S.C. 154(b) by 184 days.

(21) Appl. No.: 12/758,036

(22) Filed: Apr. 12, 2010

(65) Prior Publication Data

US 2011/0090682 A1 Apr. 21, 2011

(30) Foreign Application Priority Data

Oct. 15, 2009 (CN) ..... 2009 1 0308306

(51) Int. Cl.
*F21V 7/20* (2006.01)

(52) U.S. Cl. ... 362/218; 362/221; 362/225; 362/249.01; 362/656

(58) Field of Classification Search ..... 362/217.13, 362/218, 240, 249.01, 651, 657, 658, 659, 362/217.04, 221–223, 227, 235, 244, 800
See application file for complete search history.

(56) References Cited

U.S. PATENT DOCUMENTS 5,103,382 A * 4/1992 Kondo et al. ..... 362/503
6,158,882 A * 12/2000 Bischoff, Jr. ..... 362/488
6,283,612 B1 * 9/2001 Hunter ..... 362/240
6,726,348 B2 * 4/2004 Gloisten ..... 362/372
6,835,151 B2 * 12/2004 Fujimine et al. ..... 475/116
6,997,576 B1 * 2/2006 Lodhie et al. ..... 362/240
7,049,761 B2 * 5/2006 Timmermans et al. ..... 315/246
7,267,461 B2 * 9/2007 Kan et al. ..... 362/373
7,438,441 B2 * 10/2008 Sun et al. ..... 362/294
7,501,299 B2 * 3/2009 Wong et al. ..... 438/31
7,594,738 B1 * 9/2009 Lin et al. ..... 362/249.02
7,635,201 B2 * 12/2009 Deng ..... 362/249.02
7,648,251 B2 * 1/2010 Whitehouse et al. ..... 362/223
7,654,703 B2 * 2/2010 Kan et al. ..... 362/362
7,766,505 B2 * 8/2010 Tseng et al. ..... 362/217.17
7,938,562 B2 * 5/2011 Ivey et al. ..... 362/276
7,946,729 B2 * 5/2011 Ivey et al. ..... 362/254
7,976,196 B2 * 7/2011 Ivey et al. ..... 362/294
7,997,770 B1 * 8/2011 Meurer ..... 362/311.02
8,072,124 B2 * 12/2011 Liu et al. ..... 313/46

* cited by examiner

*Primary Examiner* — John A Ward

(74) *Attorney, Agent, or Firm* — Altis Law Group, Inc.

(57) ABSTRACT

An LED (light emitting diode) tube includes a connecting member, an LED module mounted on a bottom side of the connecting member, a driving circuit module mounted on a top side of the connecting member, two covers engaging with two opposite lateral sides of the connecting member and two connectors. The two covers cover the driving circuit module and the LED module, respectively. The two connectors are located at two opposite ends of the LED tube. Two recesses are cooperatively defined by the two covers and the connecting member in two opposite sides of the LED tube and along a length of the LED tube. The recesses separate the two covers from each other and each have a width less than 12 mm.

17 Claims, 4 Drawing Sheets

LED TUBE

BACKGROUND

1. Technical Field

The disclosure relates generally to illuminating devices and, more particularly, to an LED (light emitting diode) tube.

2. Description of Related Art

Fluorescent tubes are used popularly in daily illumination. When a fluorescent tube is energized, the mercury vapor contained in the tube will be stimulated, giving out ultraviolet radiation. When the ultraviolet radiation strikes a phosphor coating the interior of the tube, visible light is produced.

However, fluorescent tubes have tube-shape shells made of transparent, fragile material such as thin glass, and further have harmful materials such as mercury vapor filled in the shells. It is well known, mercury or mercury vapor is a great contamination to environment, and also a severe poison to human. Once the fluorescent tubes were broken, mercury or mercury vapor would leak out immediately from fluorescent tubes to cause an atmospheric pollution or a severe damage to ambient people. Therefore, fluorescent tubes have a great hidden trouble and are in high risk of causing damage to both people and environment directly.

What is needed, therefore, is an LED tube having no harmful material such as mercury, thereby overcoming the above-described problems.

BRIEF DESCRIPTION OF THE DRAWINGS

Many aspects of the disclosure can be better understood with reference to following drawings. The components in the drawings are not necessarily drawn to scale, the emphasis instead being placed upon clearly illustrating the principles of the disclosure. Moreover, in the drawings, like reference numerals designate corresponding parts throughout several views.

DETAILED DESCRIPTION

Figure 1:
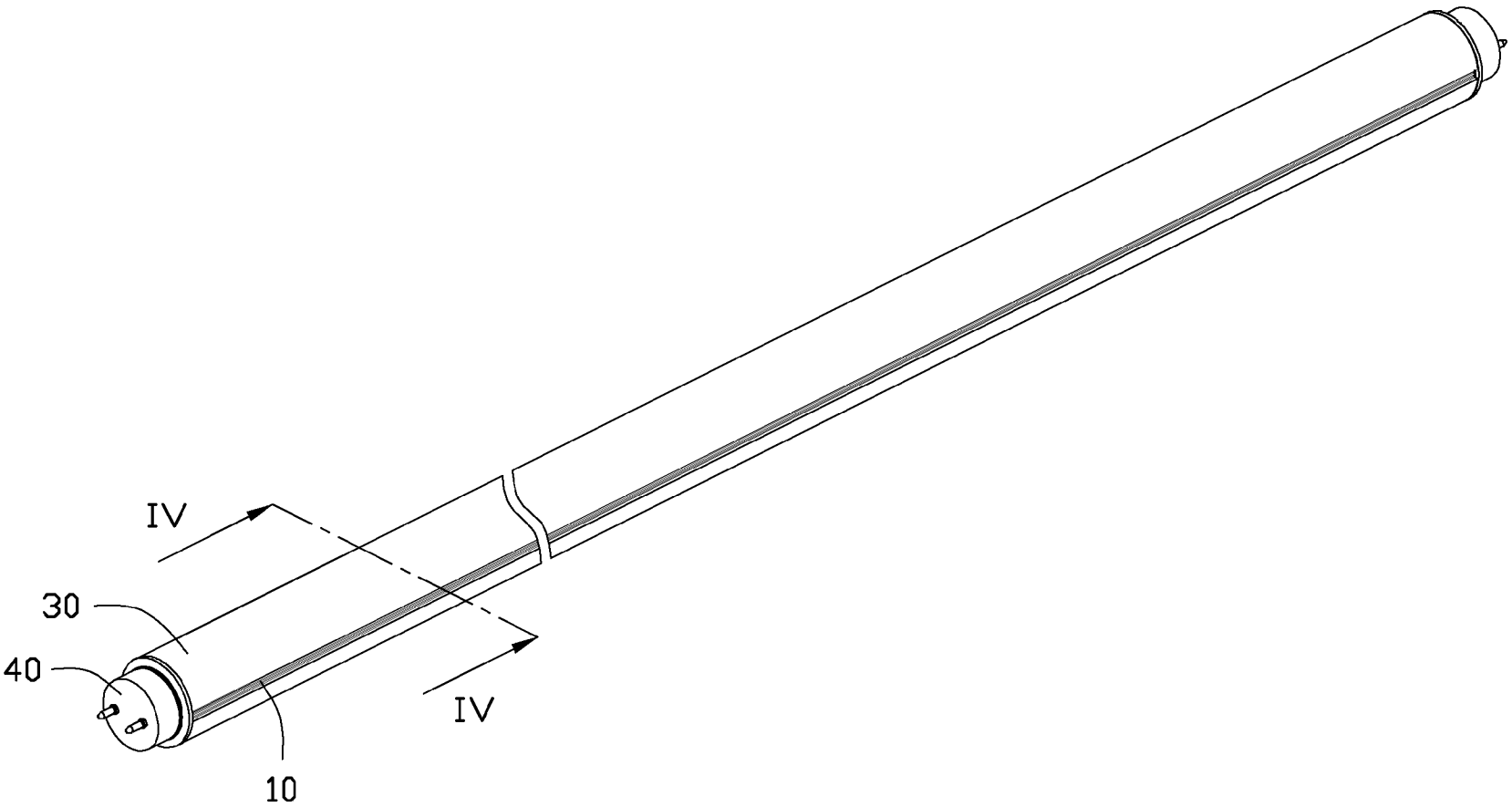
FIG. 1 is an isometric, assembled view of an LED tube in accordance with an embodiment of the disclosure.
Figure 2:
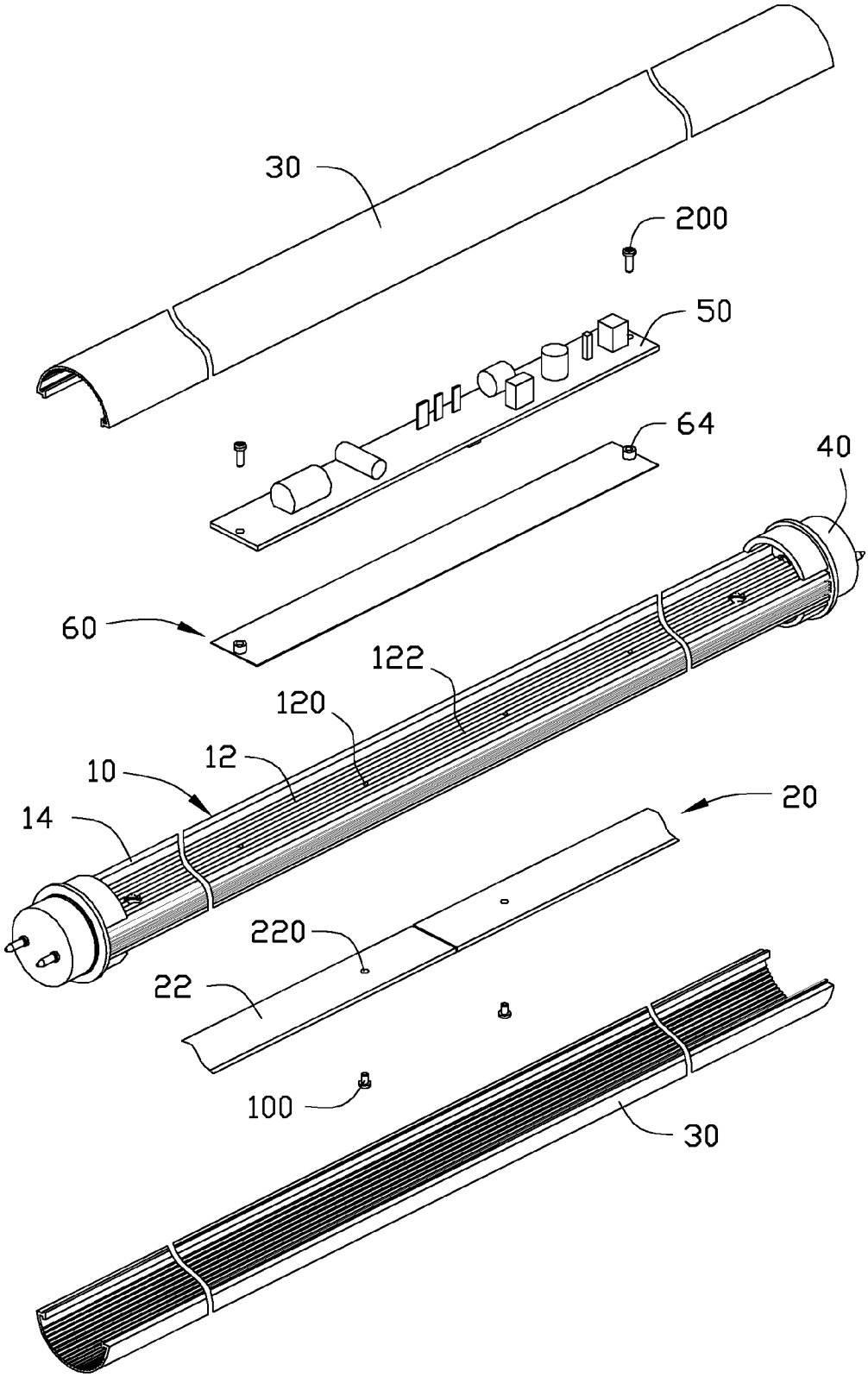
FIG. 2 is an exploded view of the LED tube of FIG. 1.

Referring to FIGS. 1-2, an LED (light emitting diode) tube is illustrated in accordance with an embodiment of the disclosure. The LED tube is used for taking place of a conventional fluorescent tube to provide light with high brightness. The LED tube comprises a connecting member 10, an LED module 20 mounted on a bottom side of connecting member 10, a driving circuit module 50, a mounting board 60 securing the driving circuit module 50 to a top side of the connecting member 10, two covers 30 fixed on the top and bottom sides of the connecting member 10 and covering the driving circuit module 50 and the LED module 20, respectively, and two connectors 40 disposed at two opposite ends of the connecting member 10 to couple the two covers 30 with the connecting member 10.

The connecting member 10 is integrally formed by aluminum extrusion. The connecting member 10 comprises an elongated, thermally conductive plate 12 and two spaced, elongated fixing parts 14 extending from two opposite lateral sides of the conductive plate 12 along a length direction of the conductive plate 12. The conductive plate 12 has a rectangular configuration. The conductive plate 12 defines a plurality of retaining holes 120 therein along a middle line thereof. A plurality of screws 100 extend through the LED module 20 to threadedly engage into the retaining holes 120, thereby fixing the LED module 20 onto a bottom surface of the conductive plate 12. The conductive plate 12 defines a plurality of heat-dissipating strips 122 on a top surface thereof to enlarge a heat dissipation area thereof. The heat-dissipating strips 122 are spaced from each other and extended along the length direction of the conductive plate 12.

Figure 3:
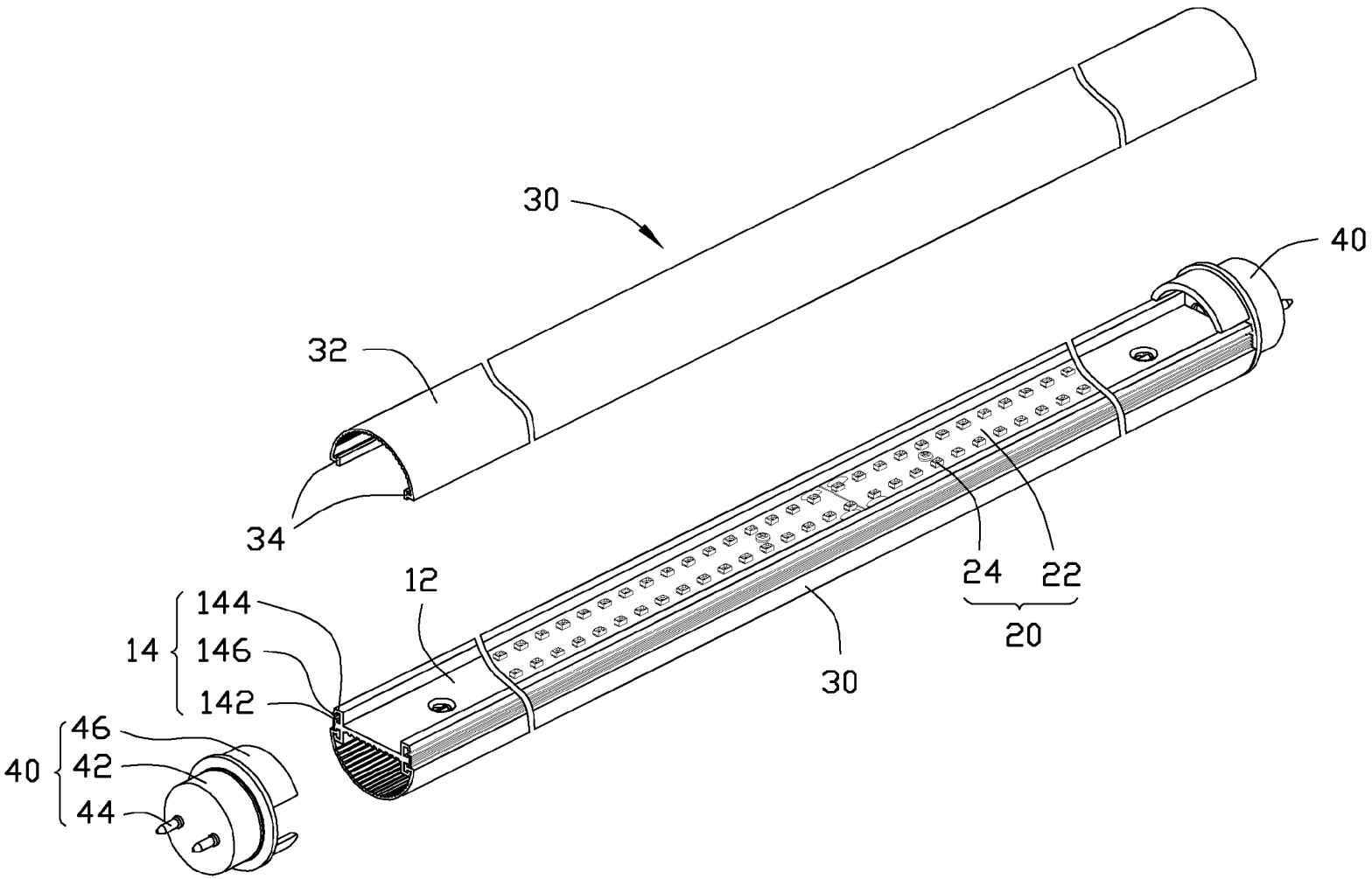
FIG. 3 is a partially exploded view of the LED tube of FIG. 1, seen from an inverted orientation.
Figure 4:
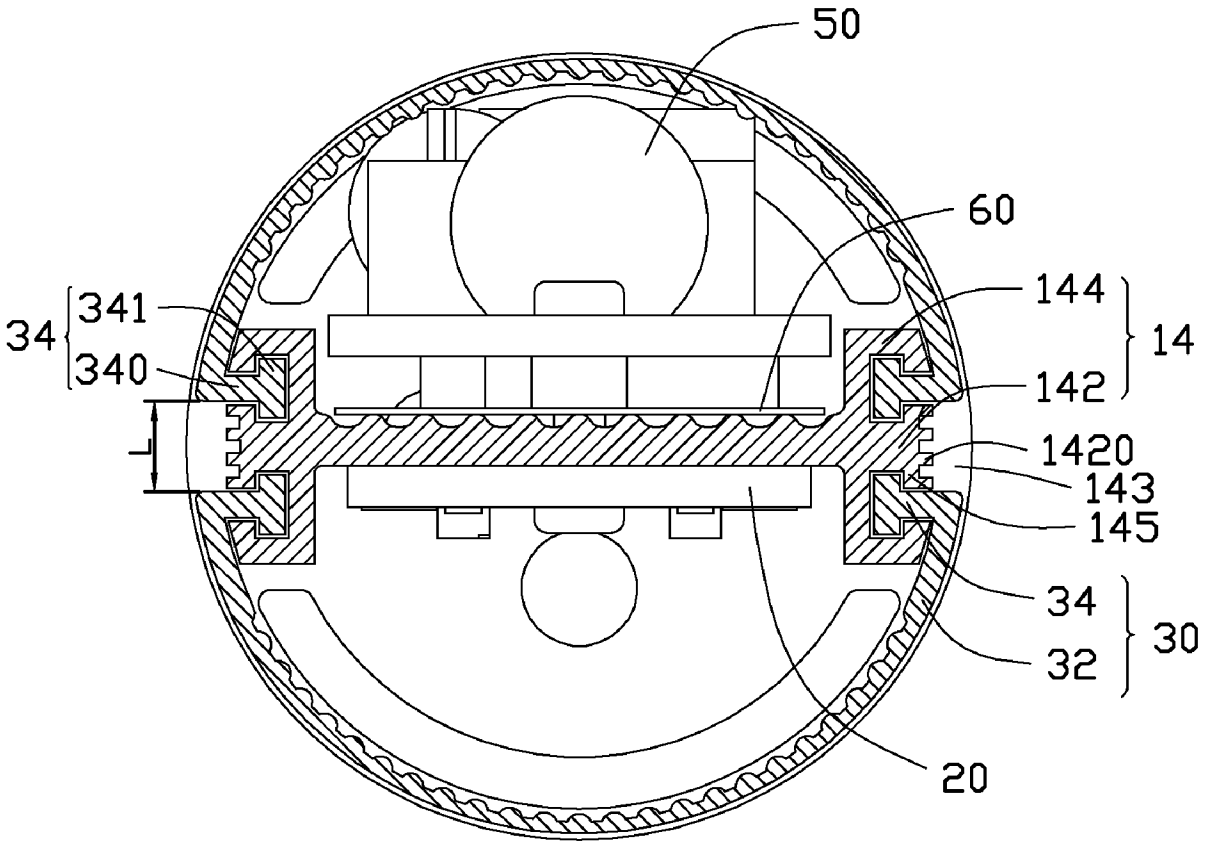
FIG. 4 is a cross sectional view of the LED tube of FIG. 1, taken along line IV-IV of FIG. 1.

Also referring to FIGS. 3-4, the fixing parts 14 are parallel to each other and sandwich the conductive plate 12 therebetween. Either fixing part 14 has a first fixing plate 142 extending outwardly and horizontally from one of the two opposite lateral sides of the conductive plate 12 and two second fixing plates 144 extending oppositely from a juncture between the first fixing plate 142 and the conductive plate 12. Either first fixing plate 142 has two protruding parts 145 extending oppositely from an outer lateral edge thereof to thus have a T-shaped configuration. Either first fixing plate 142 has a plurality of fins 1420 extending outwardly and horizontally from an outer lateral side thereof along the length direction of the conductive plate 12. The fins 1420 are spaced from and parallel to each other.

In either fixing part 14, one of the second fixing plates 144 bends firstly upwardly and outwardly from the juncture between a corresponding first fixing plate 142 and the conductive plate 12, and then is curved back towards the corresponding first fixing plate 142 to form a latching slot 146 between the corresponding first fixing plate 142 and the one of the second fixing plates 144. The other one of the second fixing plates 144 bends firstly downwardly and outwardly from the juncture between the corresponding first fixing plate 142 and the conductive plate 12, and then is curved back towards the corresponding first fixing plate 142 to form another latching slot 146 between the corresponding first fixing plate 142 and the other one of the second fixing plates 144. The latching slot 146 is similar to the another latching slat 146. Each of the latching slots 146 has a T-shaped cross section, with two T-shaped openings which open towards two opposite ends of the fixing part 14 and an elongated, rectangular opening which opens towards a lateral outside of the LED tube and extends along the length direction of the conductive plate 12, as better viewed from FIG. 4.

The LED module 20 comprises an elongated printed circuit board 22 and a plurality of LEDs 24 mounted on the printed circuit board 22. The LEDs 24 are arranged in two rows along a length direction of the printed circuit board 22. In each row, the LEDs 24 are arranged at equal intervals. A plurality of fixing holes 220 are defined therein along the length direction of the printed circuit board 22 and located between the two rows of LEDs 24. The screws 100 extend through the fixing holes 220 to threadedly engage into the retaining holes 120 of the connecting member 10, thereby fixing the LED module 20 onto a central portion of the bottom surface of the conductive plate 12 of the connecting member 10.

The covers 30 are made of transparent or translucent materials, such as polycarbonate. Each of the covers 30 has an elongated configuration. Either cover 30 comprises an arc-shaped covering portion 32 and two engaging portions 34 respectively formed at inner sides of two distal edges of the covering portion 32. The covering portion 32 has a plurality of protruding strips (not labeled) on an inner surface thereof for diffusing light emitted from the LED module 20. Each of the engaging portions 34 is T-shaped in cross section with a cross sectional size the same as that of a corresponding latching slot 146 of the connecting member 10, thereby being fittingly received in the corresponding latching slot 146 when the cover 30 and the connecting member 10 are assembled together. Each of the engaging portions 34 comprises an elongated first receiving portion 340 extending inwardly from an inner side of a corresponding distal edge of the covering portion 32 and an elongated second receiving portion 341 protruding oppositely (i.e., upwardly and downwardly) from a distal end of the first receiving portion 340.

Each of the connectors 40 comprises a cylindrical connecting portion 42 and two spaced, arc-shaped mounting portions 46 extending outwardly from a side of the connecting portion 42. The mounting portions 46 are received in a tube formed by the connecting member 10 and the covering portions 32 of the two covers 30 and abut against the covering portions 32. Two inserting pins 44 extend through the connecting portion 42 and are fixed on the connecting portion 42. Each of the inserting pins 44 has a first end (not labeled) and a second end (not shown) opposite to the first end. The first end of each of the inserting pins 44 is located at an outside of the connecting portion 42. The second end of each of the inserting pins 44 is enclosed by the mounting portions 46. The second ends of the inserting pins 44 are electrically connected with an anode and a cathode of the driving circuit module 50, respectively. The first ends of the inserting pins 44 are electrically connected with an anode and a cathode of a power source (not shown), respectively, through a socket of a conventional fluorescent tube holder. The power source provides power for the LED tube via the inserting pins 44.

The driving circuit module 50 is electrically connected to the LED module 20 and secured on the conductive plate 12 of the connecting member 10 via the mounting board 60. The mounting board 60 is preferably made of metallic materials to remove heat from the driving circuit module 50. Two spaced mounting posts 64 extend upwardly from two opposite ends of the mounting board 60. Two bolts 200 extend through the driving circuit module 50 and the mounting posts 64 to engage with the conductive plate 12, thereby securing the mounting board 60 to a central portion of the top surface of the conductive plate 12. The mounting board 60 is sandwiched between the driving circuit module 50 and the top surface of the conductive plate 12. The driving circuit module 50 is thermally connected to the mounting board 60 and electrically connected the LED module 20 and the power source.

In assembly, the LED module 20 is mounted on the center of the bottom surface of the conductive plate 12 of the connecting member 10. The driving circuit module 50 is fixed on the center of the top surface of the conductive plate 12 and electrically connected with the LED module 20. The engaging portions 34 of the two covers 30 slide into the latching slots 146 of the fixing parts 14 of the connecting member 10 from an end of the connecting member 10 to an opposite end of the connecting member 10. The engaging portions 34 of the covers 30 are fittingly received in the latching slots 146 so that the covers 30 are fixed on the top and bottom sides of the connecting member 10, respectively. The mounting portions 46 of the connector 40 are received in the tube formed by the connecting member 10 and the covering portions 32 of the covers 30 and abut against the inner surfaces of the covering portions 32. Thus, the connectors 40, the covers 30 and the connecting member 10 are assembled together. The two second ends of the two inserting pins 44 are electrically connected with the anode and the cathode of the driving circuit module 50. The two first ends of the two inserting pins 44 are provided for electrically connecting with the anode and the cathode of the powder source.

The covering portions 32 of the two covers 30 and the connecting member 10 form the tube. The fixing parts 14 are located between the two covers 30 and located in two elongated recesses 143 defined in two opposite sides of an outside of the tube, so that the connecting member 10 can not be reached or touched by fingers of a person holding/manipulating the LED tube. The elongated recesses 143 extend along a length direction of the tube and each have an elongated, rectangular opening (not labeled) with a width L less than 12 mm; that is L<12 mm. Therefore, the LED tube is very safe to be used, that is to say, there is not risk for a person using the LED tube to get an electric shock from electric current or static electricity in the LED tube, especially through the connecting member 10.

It is to be understood, however, that even though numerous characteristics and advantages of the disclosure have been set forth in the foregoing description, together with details of the structure and function of the disclosure, the disclosure is illustrative only, and changes may be made in detail, especially in matters of shape, size, and arrangement of parts within the principles of the disclosure to the full extent indicated by the broad general meaning of the terms in which the appended claims are expressed.

What is claimed is:

1. An LED (light emitting diode) tube comprising:

a connecting member;

a driving circuit module mounted on a top side of the connecting member;

an LED module mounted on a bottom side of the connecting member;

two covers engaging with two opposite lateral sides of the connecting member and covering the LED module and the driving circuit module, respectively; and two connectors located at two opposite ends of the LED tube and engaging with the two covers;

wherein two recesses are cooperatively defined by the two covers and the connecting member in two opposite sides of the LED tube and along a length of the LED tube, the two recesses separating the two covers from each other.

2. The LED tube as claimed of claim 1, wherein each of the recesses has an opening with a width less than 12 mm.

3. The LED tube as claimed of claim 1, wherein the two opposite lateral sides of the connecting member are located in the two recesses, the two opposite lateral sides of the connecting member being located inside of a circumferential outer surface of the LED tube.

4. The LED tube as claimed of claim 1, wherein the connecting member is made of a heat conductive material, the connecting member comprising a conductive plate and two fixing parts formed at two opposite lateral sides of the conductive plate and connecting with the covers.

5. The LED tube as claimed of claim 4, wherein each of the covers comprises a covering portion and two engaging portions extending inwardly from two distal edges of the covering portion, the two engaging portions being engagingly received in the two fixing parts of the connecting member.

6. The LED tube as claimed of claim 5, wherein two separated latching slots are defined in each of the fixing parts for receiving corresponding engaging portions of the covers, each of the latching slots being T-shaped in cross section and having an elongated opening at an outer side of each of the fixing parts.

7. The LED tube as claimed of claim 6, wherein each of the engaging portions has a T-shaped in cross section with a cross sectional size the same as that of a corresponding latching slot of each of the fixing parts, each of the engaging portions sliding into the corresponding latching slot from an end of the connecting member to an opposite end of the connecting member until the engaging portion is fully received in the corresponding latching slot.

8. The LED tube as claimed of claim 7, wherein each of the fixing parts has a first fixing plate extending outwardly and horizontally from one of the two opposite lateral sides of the conductive plate and two second fixing plates extending oppositely from a juncture between the first fixing plate and the conductive plate, the latching slots being formed between the first and second fixing plates of each of the fixing parts.

9. The LED tube as claimed of claim 8, wherein each of the first fixing plates has two protruding parts extending oppositely from an outer lateral edge thereof to thus have a T-shaped configuration, the second fixing plates of each of the fixing parts firstly extending upwardly or downwardly and outwardly from the juncture between the first fixing plate and the conductive plate and then is curved back toward the first fixing plate to form the latching slots between the first and second fixing plates.

10. The LED tube as claimed of claim 5, wherein the covering portions of the covers each have an arc-shaped configuration and cover the top and bottom sides of the connecting member, respectively.

11. The LED tube as claimed of claim 10, wherein the covering portions of the covers are coupled together via the connecting member to cooperatively form a tube, the two fixing parts of the connecting member being located inside of a circumferential outer surface of the tube.

12. The LED tube as claimed of claim 11, wherein the connectors are mounted on two opposite ends of the tube and electrically connected with the driving circuit module.

13. An LED (light emitting diode) tube comprising:

a connecting member comprising a conductive plate, two pairs, of latching slots being respectively defined at two opposite lateral sides of the conductive plate, each pair of latching slots being spaced from each other, each of the latching slots opening towards an outside of the LED tube;

a driving circuit module mounted on a top side of the conductive plate of the connecting member;

an LED module mounted on a bottom side of the conductive plate of the connecting member;

two covers each comprising two engaging portions extending inwards from two distal edges thereof, the engaging portions of the covers sliding into corresponding latching slots of the connecting member to thus connect the two covers to the connecting member so that the covers cover the driving circuit module and the LED module, respectively; and two connectors connected to two opposite ends of a tube formed by the connecting member and the covers.

14. The LED tube as claimed of claim 13, wherein two recesses are defined in two opposite sides of the LED tube and along a length of the LED tube and separate the two covers from each other.

15. The LED tube as claimed of claim 14, wherein each of the recesses has an opening with a width less than 12 mm.

16. The LED tube as claimed of claim 13, wherein each of the latching slots of the connecting member is T-shaped in cross section.

17. The LED tube as claimed of claim 16, wherein each of the engaging portions of the covers is T-shaped in cross section with a cross sectional size the same as that of a corresponding latching slot of the connecting member, thereby being fittingly received in the corresponding latching slot.

* * * * *